US011808154B2

(12) United States Patent
Quach et al.

(10) Patent No.: US 11,808,154 B2
(45) Date of Patent: Nov. 7, 2023

(54) CMC COMPONENT FLOW DISCOURAGER FLANGES

(71) Applicant: RAYTHEON TECHNOLOGIES CORPORATION, Farmington, CT (US)

(72) Inventors: San Quach, Southington, CT (US); Bryan P. Dube, Columbia, CT (US); Erik R. Granstand, West Hartford, CT (US); Michael G. McCaffrey, Windsor, CT (US); Stephen G. Pixton, South Windsor, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/952,693

(22) Filed: Sep. 26, 2022

(65) Prior Publication Data

US 2023/0036836 A1 Feb. 2, 2023

Related U.S. Application Data

(63) Continuation of application No. 17/221,036, filed on Apr. 2, 2021, now Pat. No. 11,454,129.

(51) Int. Cl.

| | |
|---|---|
| ***F01D 11/00*** | (2006.01) |
| ***F01D 5/14*** | (2006.01) |
| ***F01D 9/04*** | (2006.01) |

(52) U.S. Cl.

CPC ..... *F01D 11/005* (2013.01); *F01D 5/147* (2013.01); *F01D 9/042* (2013.01); *F05D 2240/12* (2013.01); *F05D 2300/6033* (2013.01)

(58) Field of Classification Search

CPC ..... F01D 5/147; F01D 5/284; F01D 9/041; F01D 9/042; F01D 11/005; F05D 2240/12; F05D 2300/6033

See application file for complete search history.

(56) References Cited

U.S. PATENT DOCUMENTS

| | | | | |
|---|---|---|---|---|
| 7,824,152 | B2 | 11/2010 | Morrison | |
| 9,314,844 | B2 | 4/2016 | Geiger | |
| 10,767,495 | B2 * | 9/2020 | Whittle | F01D 5/189 |
| 10,767,497 | B2 | 9/2020 | Vetters et al. | |
| 10,830,063 | B2 * | 11/2020 | Freeman | F01D 9/042 |
| 2008/0279679 | A1 | 11/2008 | Morrison | |
| 2010/0275572 | A1 | 11/2010 | Durocher et al. | |
| 2013/0014512 | A1 | 1/2013 | Jarmon et al. | |
| 2016/0069199 | A1 | 3/2016 | Duelm et al. | |

(Continued)

FOREIGN PATENT DOCUMENTS

| | | |
|---|---|---|
| EP | 3597865 | 1/2020 |

OTHER PUBLICATIONS

European Search Report for European Patent Application No. 22165971.7 dated Aug. 16, 2022.

*Primary Examiner* — Courtney D Heinle
*Assistant Examiner* — Danielle M. Christensen
(74) *Attorney, Agent, or Firm* — Carlson, Gaskey & Olds, P.C.

(57) ABSTRACT

In one exemplary embodiment, a flow path component assembly includes a support structure having an axial portion and a radial portion and an outer portion arranged between the support structure. The outer portion defines a gap between the outer portion and the axial portion of the support structure. A flange is positioned relative to the gap.

19 Claims, 4 Drawing Sheets

(56) References Cited

U.S. PATENT DOCUMENTS

| | | | | |
|---|---|---|---|---|
| 2016/0084096 | A1 | 3/2016 | Carr et al. | |
| 2020/0025025 | A1* | 1/2020 | Sippel | F01D 9/065 |
| 2020/0040749 | A1 | 2/2020 | Holleran et al. | |
| 2020/0072066 | A1 | 3/2020 | Thomas | |

* cited by examiner

CMC COMPONENT FLOW DISCOURAGER FLANGES

CROSS REFERENCE TO RELATED APPLICATION

This application is a continuation of U.S. application Ser. No. 17/221,036 filed on Apr. 2, 2021.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The compressor or turbine sections may include vanes mounted on vane platforms. Seals may be arranged at leading and trailing edges of such components to reduce cooling flow leakage.

SUMMARY OF THE INVENTION

In one exemplary embodiment, a flow path component assembly includes a support structure that is a unitary component having an axial portion and a radial portion and an outer portion arranged between the support structure and a flow path. The outer portion defines a gap between the outer portion and the support structure axial portion. A flange extends into the gap.

In another embodiment according to any of the previous embodiments, the flange extends from the outer portion towards the support structure.

In another embodiment according to any of the previous embodiments, the flange extends from the support structure axial portion towards the outer portion.

In another embodiment according to any of the previous embodiments, a seal is arranged in the gap.

In another embodiment according to any of the previous embodiments, the flange is arranged between the seal and the radial portion.

In another embodiment according to any of the previous embodiments, the seal is arranged between the flange and the radial portion.

In another embodiment according to any of the previous embodiments, the flange is formed in the outer portion and a second flange is formed in the support structure.

In another embodiment according to any of the previous embodiments, the flange is near a leading edge.

In another embodiment according to any of the previous embodiments, the flange is near a trailing edge.

In another embodiment according to any of the previous embodiments, the platform is a vane platform.

In another embodiment according to any of the previous embodiments, the support structure extends between an inner vane platform and an outer vane platform.

In another embodiment according to any of the previous embodiments, the outer portion is formed from a ceramic material.

In another embodiment according to any of the previous embodiments, the support structure is formed from a metallic material.

In another exemplary embodiment, a turbine section for a gas turbine engine includes a plurality of vanes arranged circumferentially about an engine axis. Each vane includes a support structure that is a unitary component having an axial portion and a radial portion, and an outer portion arranged between the support structure and a flow path. The outer portion is formed from a ceramic material. The outer portion defines a gap between the outer portion and the support structure axial portion. A flange extending radially from one of the axial portion and the outer portion. The flange is configured to at least partially block the gap.

In another embodiment according to any of the previous embodiments, a seal is arranged in the gap.

In another embodiment according to any of the previous embodiments, the flange extends from the outer portion towards the support structure.

In another embodiment according to any of the previous embodiments, the flange extends from the support structure towards the outer portion.

In another embodiment according to any of the previous embodiments, the outer portion has an outer axial portion that forms an outer platform of the vane.

In another embodiment according to any of the previous embodiments, the flange is arranged near a leading edge and extends forward of the axial portion and a second flange is arranged near a trailing edge and is forward of an aft end of the axial portion.

In another embodiment according to any of the previous embodiments, the flange is formed in the outer portion and a second flange is formed in the support structure.

The present disclosure may include any one or more of the individual features disclosed above and/or below alone or in any combination thereof.

DETAILED DESCRIPTION

Figure 1:
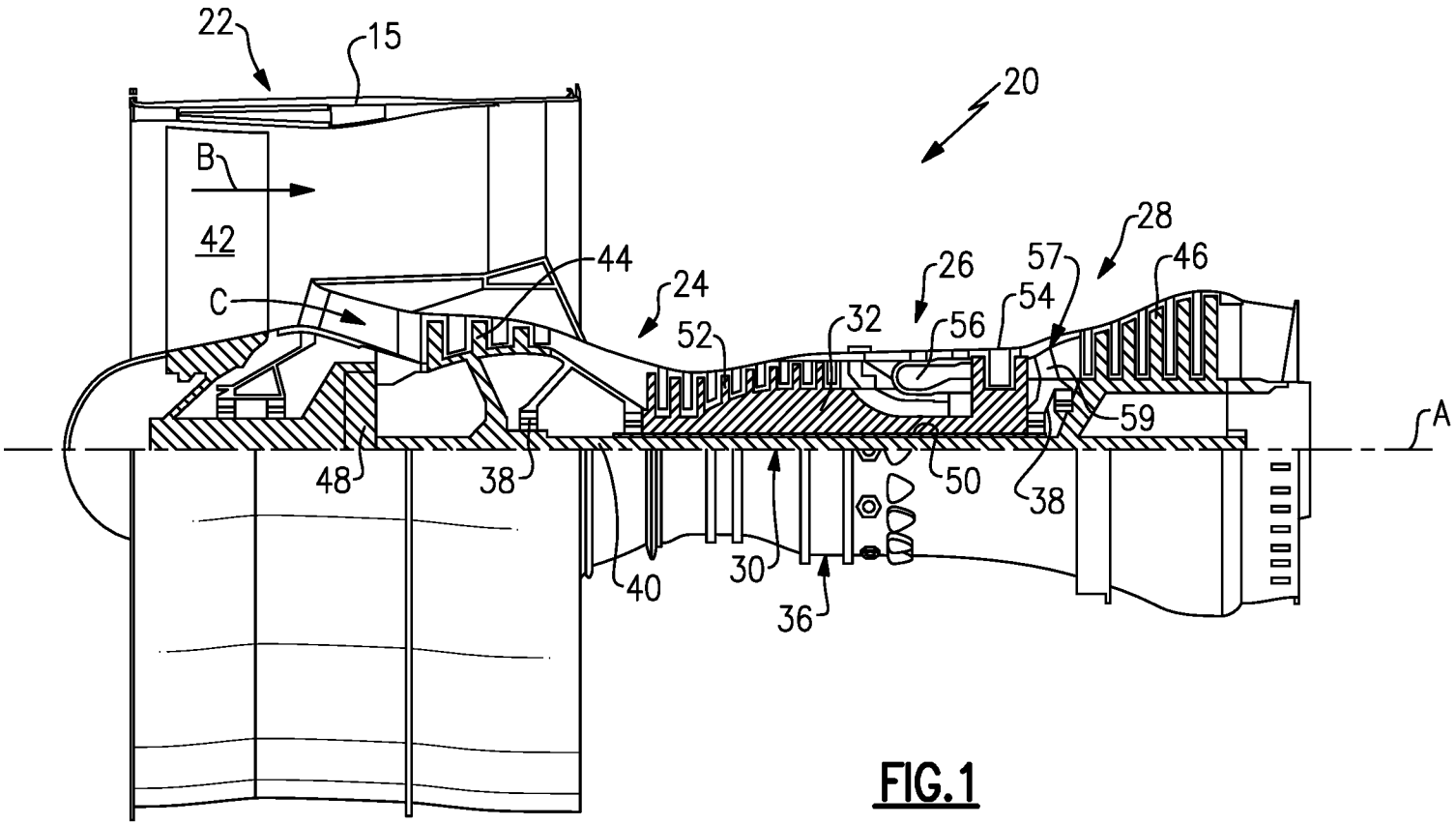
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
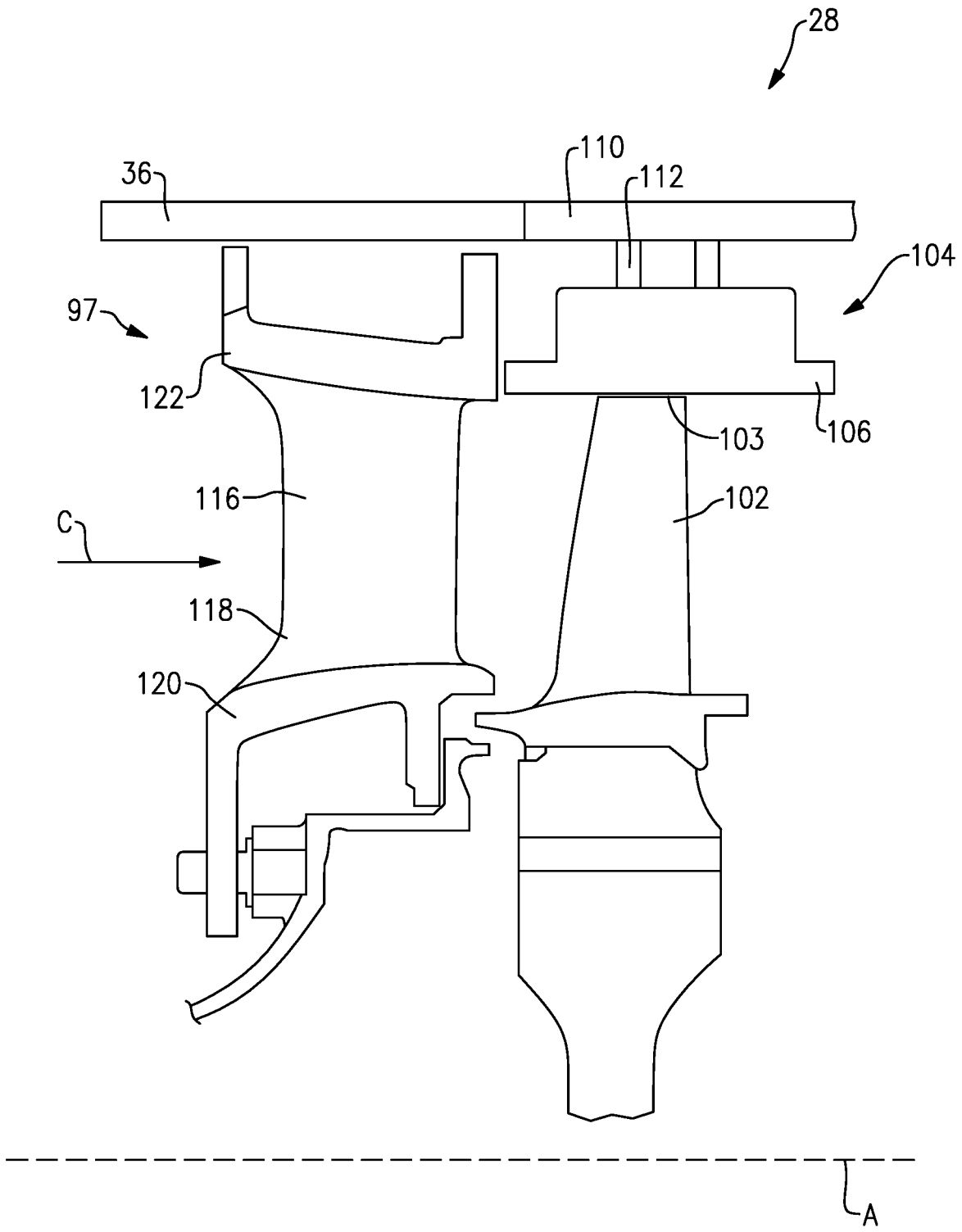
FIG. 2 schematically illustrates a portion of an example turbine section.

FIG. 2 shows a portion of an example turbine section 28, which may be incorporated into a gas turbine engine such as the one shown in FIG. 1. However, it should be understood that other sections of the gas turbine engine 20 or other gas turbine engines, and even gas turbine engines not having a fan section at all, could benefit from this disclosure. The turbine section 28 includes a plurality of alternating turbine blades 102 and turbine vanes 97.

A turbine blade 102 has a radially outer tip 103 that is spaced from a blade outer air seal assembly 104 with a blade outer air seal ("BOAS") 106. The BOAS 106 may be mounted to an engine case or structure, such as engine static structure 36 via a control ring or support structure 110 and a carrier 112. The engine structure 36 may extend for a full 360° about the engine axis A.

The turbine vane assembly 97 generally comprises a plurality of vane segments 118. In this example, each of the vane segments 118 has an airfoil 116 extending between an inner vane platform 120 and an outer vane platform 122.

Figure 3:
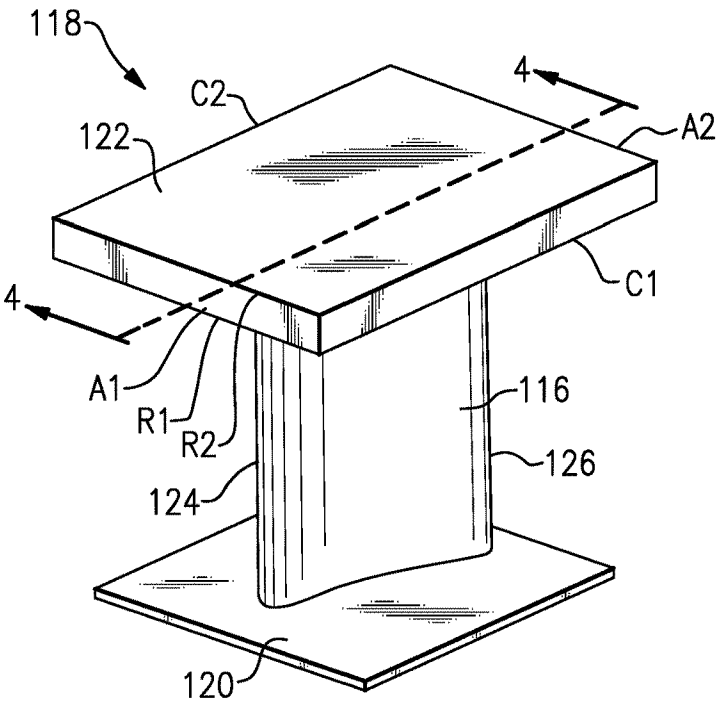
FIG. 3 schematically illustrates an example turbine vane assembly.

FIG. 3 illustrates an example vane segment 118. The vane segment 118 has an outer platform 122 radially outward of the airfoil 116 and an inner platform 120 radially inward of the airfoil 116. Each platform 122 has radially inner and outer sides R1, R2, respectively, first and second axial sides A1, A2, respectively, and first and second circumferential sides C1, C2, respectively. The radially inner side R1 faces in a direction toward the engine central axis A. The radially inner side R1 is thus the gas path side of the outer vane platform 122 that bounds a portion of the core flow path C. The first axial side A1 faces in a forward direction toward the front of the engine 20 (i.e., toward the fan 42), and the second axial side A2 faces in an aft direction toward the rear of the engine 20 (i.e., toward the exhaust end). In other words, the first axial side A1 is near the airfoil leading end 124 and the second axial side A2 is near the airfoil trailing end 126. The first and second circumferential sides C1, C2 of each platform 122 abut circumferential sides C1, C2 of adjacent platforms 122.

Although a vane platform 122 is described, this disclosure may apply to other components, and particularly flow path components. For example, this disclosure may apply to combustor liner panels, shrouds, transition ducts, exhaust nozzle liners, blade outer air seals, or other CMC components. In the illustrated example, the example vane segment 118 is a singlet, meaning the vane segment 118 includes only one airfoil section 116. This disclosure is not limited to singlets, it may be doublets, triplets etc., however. Further, while the example vane segment 118 is in the high pressure turbine section 54, one would understand that this disclosure can be used in other sections of the engine 20 such as the mid-turbine frame 57. Further, although the outer vane platform 122 is generally shown and referenced, this disclosure may apply to the inner vane platform 120.

Figure 4:
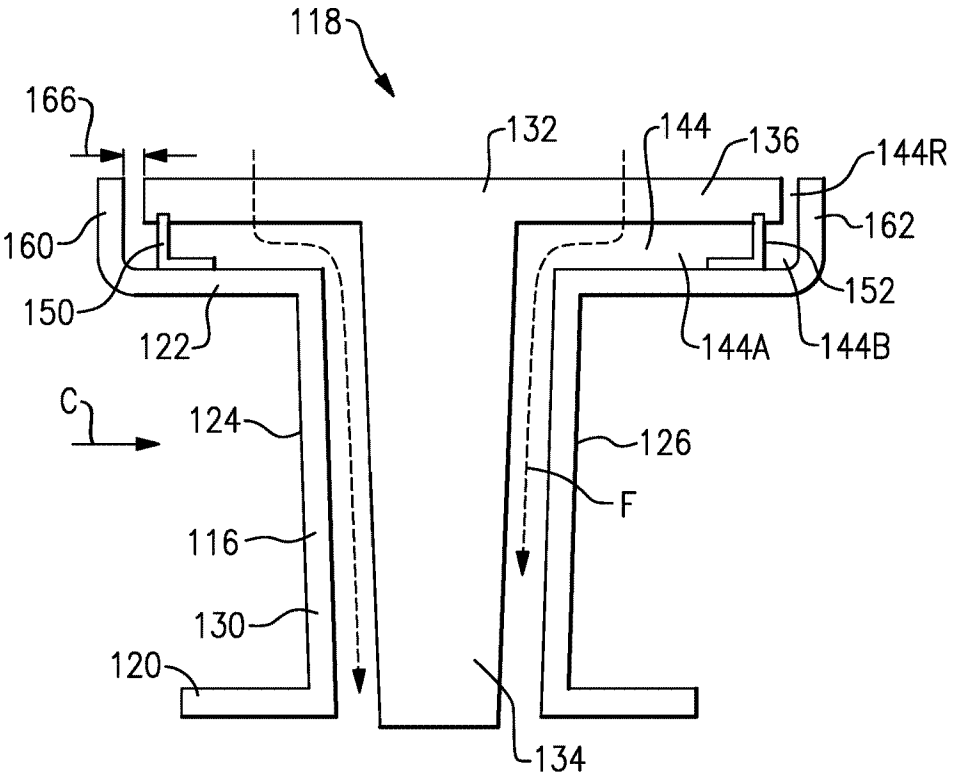
FIG. 4 schematically illustrates a cross-sectional view of an example turbine vane assembly.

FIG. 4 illustrates a cross-sectional view of the vane segment 118 along the line 4-4 of FIG. 3. The segment 118 generally includes an outer portion 130 and a support structure 132. The support structure 132 has a radially extending portion 134 and an axially extending portion 136. The support structure 132 provides structural support for the vane 118. The radially extending portion 134 and the axially extending portion 136 may be formed as a single unitary component, for example. The support structure 132 may be formed from a metallic material.

The outer portion 130 forms the airfoil 116 and inner and outer platforms 120, 122. The outer portion 130 is arranged within the core flowpath C. That is, the outer portion 130 is a portion of the segment 118 that is exposed to the core flowpath C. The outer portion 130 may be formed of a ceramic matrix composite ("CMC") material. The outer portion 130 may formed of a plurality of CMC laminate sheets. The laminate sheets may be silicon carbide fibers, formed into a braided or woven fabric in each layer. In other examples, the outer portion 130 may be made of a monolithic ceramic. CMC components such as outer portion 130 are formed by laying fiber material, such as laminate sheets or braids, in tooling, injecting a gaseous infiltrant into the tooling, and reacting to form a solid composite component. The component may be further processed by adding additional material to coat the laminate sheets. CMC components may have higher operating temperatures than components formed from other materials.

The outer portion 130 may be spaced from the support structure 132 to form a gap 144 between the outer portion 130 and the support structure 132. The gap 144 may be used for directing cooling flow, for example. The gap 144 may include an axial segment 144A joined with a radial segment 144R at a bend 144B (e.g., FIG. 4). In the illustrated example, cooling flow F flows through the axially extending portion 136 of the support 132 to cool the vane assembly 118. In this example, a first seal 150 and a second seal 152 are arranged between the outer portion 130 and the support structure 132. The first seal 150 is arranged near the leading edge 124 and the second seal 152 is arranged near the trailing edge 126. The seals 150, 152 may be L-seals, for example. In this example, the first seal 150 prevents hot gases from the core flowpath C from entering the gap 144, and the second seal 152 prevents cooling flow F from leaking from the vane assembly 118.

The outer platform 122 of the outer portion 130 has a first flange 160 and a second flange 162. The first and second flanges 160, 162 extend radially into the gap 144 between the outer portion 130 and the support structure 132. In this example, the first and second flanges 160, 162 extend radially outward from the outer portion 130 towards the axially extending portion 136 of the support structure 132. A clearance 166 in the axial direction is formed between the flanges 160, 162 and the axially extending portion 136. The clearance 166 may be between about 0.005 and about 0.020 inches (0.127 to 0.508 mm), for example. The flanges 160, 162 partially block the gap 144 and help prevent cooling flow leakage and/or hot gas ingestion by creating a torturous path between the support structure 132 and the outer portion 130. Although a particular arrangement with flanges 160, 162 is shown, the flanges may have a different arrangement, as shown and described below.

Figure 5:
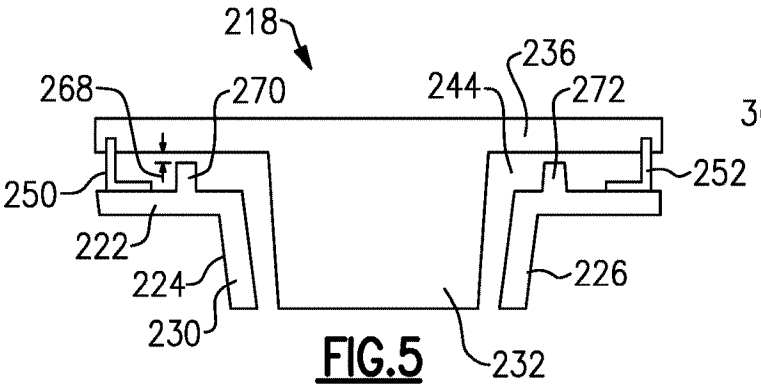
FIG. 5 schematically illustrates another arrangement for an example vane assembly.

FIG. 5 illustrates another arrangement for an example vane assembly 218. In this example, the flanges 270, 272 terminate radially inward of the axial portion 236 of the support structure 232. In this example, the outer portion 230 includes flanges 270, 272 that are axially inward of the seals 250, 252 relative to the radial portion 234 of the support structure 232. In other words, the flange 270 near the leading edge 224 is aft of the seal 250 and the flange 272 is forward of the seal 252. In this example, there may be a clearance 268 in the radial direction between the flange 270 and the axial portion 236 of the support structure 232. In one example, the clearance 268 may be between about 0.005 and about 0.070 inches (0.127 to 1.78 mm), for example. That is, in this example, the flanges 270, 272 do not contact the axial portion 236 of the support structure 232. The flanges 270, 272 do not provide structural support to the assembly in this example. In this example, the flanges 270, 272 form a labyrinth flow discourager, and obstruct cooling air from leaking by introducing flow turning with edges and corners of the flanges 270, 272.

Figure 6:
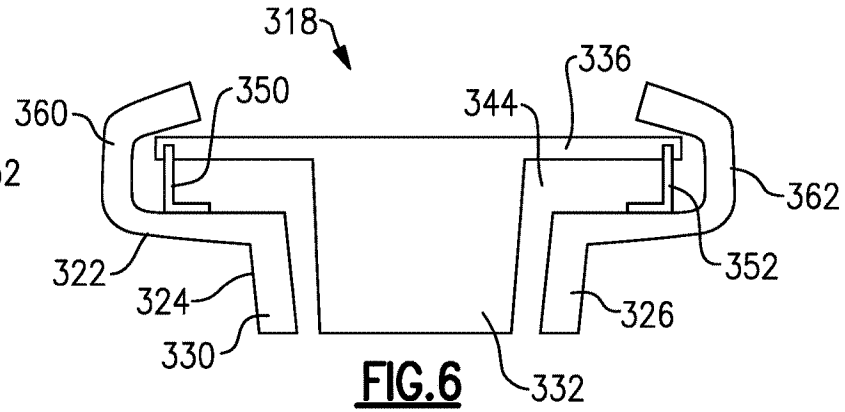
FIG. 6 schematically illustrates another arrangement for an example vane assembly.

FIG. 6 illustrates another arrangement for an example vane assembly 318. In this example, the flanges 360, 362 wrap around the axial portion 336 of the support structure 332. That is, the flanges 360 extend radially outward of the axial portion 336. The first flange 360 extends axially forward of the axial portion 336, then curves to face axially aft. The second flange 362 extends axially aft of the axial portion 336, then curves to face axially forward. The flanges 360, 362 may be integrally formed as part of a CMC preform, or may be formed via machining. The flanges 360, 362 may reduce cooling flow leakage by creating a longer and more tortuous flow path for cooling flow leakage.

Figure 7:
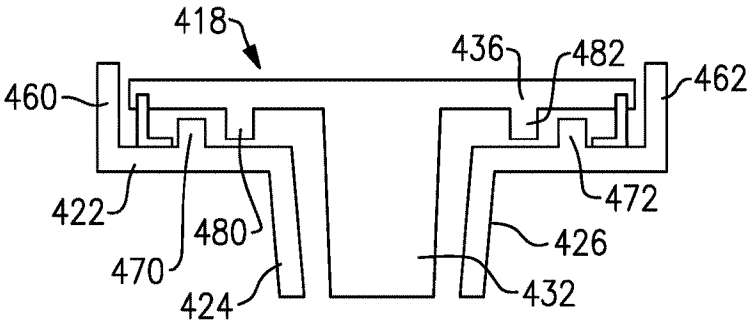
FIG. 7 schematically illustrates another arrangement for an example vane assembly.

FIG. 7 illustrates another arrangement for an example vane assembly 418. In this example, multiple flanges may be used near the leading and/or trailing edges 424, 426. For example, the leading edge 424 includes a forward flange 460 that extends radially beyond the axial portion 436 and a forward flange 470 that terminates radially inward of the axial portion 436. The trailing edge 426 includes an aft flange 462 that extends radially beyond the axial portion 436 and an aft flange 472 that terminates radially inward of the axial portion 436. In this example, the flanges 480, 482 may extend from the axially extending portion 436 of the support structure 432. The flanges 480, 482 may be a metallic material and formed integrally with the support structure 432, for example. This arrangement functions as a labyrinth seal by creating a tortuous flow path for cooling flow leakage.

Figure 8:
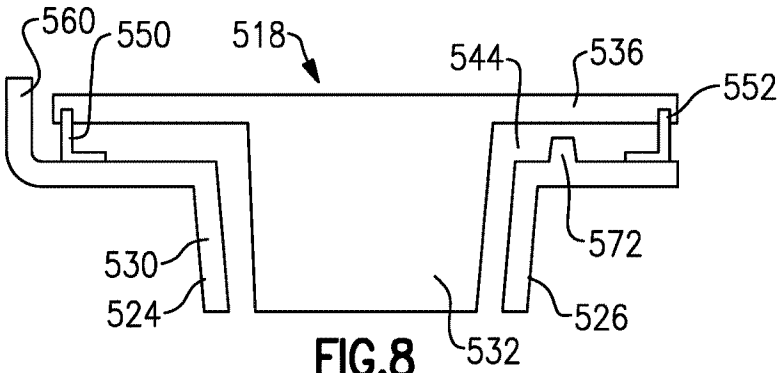
FIG. 8 schematically illustrates another arrangement for an example vane assembly.

FIG. 8 illustrates another arrangement for an example vane assembly 518. In this example, the outer portion 530 has a flange 560 near the leading edge 524, and a different flange 572 near the trailing edge 526. The leading and trailing edges 524, 526 may have differing sealing needs, and thus different seal and flange arrangements. For example, the seal 550 near the leading edge 524 may protect primarily against core flow path ingestion, while the seal 552 near the trailing edge 526 may protect primarily against cooling flow leakage. In the event the seal 550 fails, the flange 560 creates a tortuous path for hot gases from the core flow path. In the event the seal 552 fails, the flange 572 creates sharp edges to slow cooling flow leakage. Although a particular flange combination is shown, other leading and trailing edge flange arrangements may be used.

Figure 9:
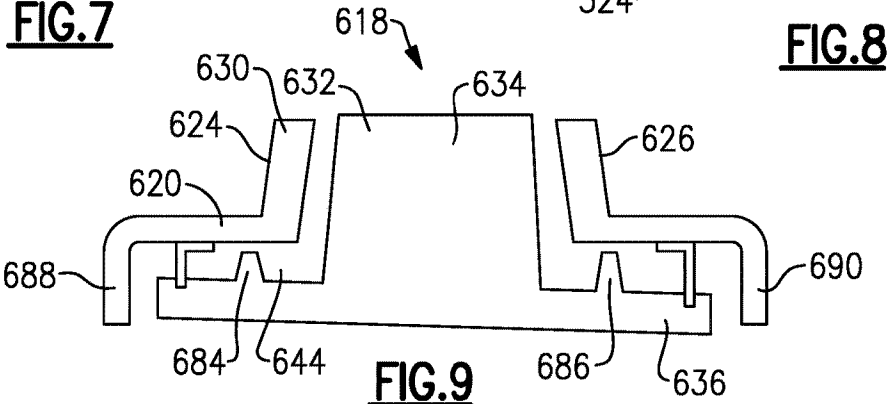
FIG. 9 schematically illustrates another arrangement for an example vane assembly.

FIG. 9 illustrates a portion of an inner vane platform 620. In this example, the outer portion 630 has a forward flange 688 and an aft flange 690. The flanges 688, 690 extend axially forward and aft, respectively, of a radial portion 634 of the support structure 632. At the inner platform 620, if the seal fails, too much cooling flow across the vane may result in unwanted thermal gradients. The flanges 684, 686, 688, 690 provide redundant protection to prevent such thermal gradients in the event a seal fails.

The disclosed flange arrangements provide redundant protection against cooling flow leakage or hot gas ingestion. The outer portion 130 may be formed from a ceramic material, which has much higher temperature capabilities than the metallic support structure 132. Thus, cooling flow leakage and/or hot gas ingestion may create unwanted thermal gradients or prematurely wear components. The flanges may help to prevent leakage of cooling air or ingestion of hot gases into the gap 144 between the support structure 132 and the outer portion 130 in the event the seals fail. The flanges form a labyrinth flow discourager by obstructing the cooling air from leaking out by turning the flow and introducing sharp edges and corners. These sharp edges and corners slow the flow of leakage, reducing the amount of cooling air that is leaked through the gap.

In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Although an embodiment of this invention has been disclosed, a worker of ordinary skill in this art would recognize that certain modifications would come within the scope of this disclosure. For that reason, the following claims should be studied to determine the true scope and content of this disclosure.

What is claimed is:

1. An airfoil assembly for a gas turbine engine, comprising:

an outer portion including an airfoil section extending in a radial direction from a first platform section, the airfoil section including an internal cavity, and the outer portion comprising a ceramic material;

a support structure having a radial portion extending in the radial direction from an axial portion, and the radial portion received in the internal cavity such that a gap is established between the outer portion and the axial portion of the support structure, and the gap extending from the internal cavity; and a flange extending in the radial direction from the first platform section of the outer portion such that the flange bounds the gap at a distance from the internal cavity;

wherein the gap includes an axial segment extending in an axial direction between the radial portion of the support structure and the first platform section, the flange is a raised protrusion extending outwardly from the first platform section at an intermediate position along the axial segment of the gap to establish a tortuous path, and the tortuous path has a lesser height along the raised protrusion than on either side of the raised protrusion.

2. The airfoil assembly as recited in claim 1, wherein the support structure comprises a metallic material.

3. The airfoil assembly as recited in claim 2, wherein the outer portion includes a second platform section, the airfoil section and the radial portion of the support structure span between the first and second platform sections.

4. The airfoil assembly as recited in claim 1, wherein the support structure is a unitary component.

5. The airfoil assembly as recited in claim 1, wherein the gap includes a radial segment joined with the axial segment at a bend, and the radial segment of the gap extends in the radial direction between the flange and an edge face of the axial portion of the support structure.

6. The airfoil assembly as recited in claim 5, wherein the support structure comprises a metallic material.

7. The airfoil assembly as recited in claim 5, further comprising a seal positioned along the axial segment of the gap, the seal spanning between the axial portion of the support structure and the first platform section.

8. The airfoil assembly as recited in claim 1, further comprising a seal positioned along the axial segment of the gap, wherein the seal spans between the axial portion of the support structure and the first platform section, and the raised protrusion is positioned between the seal and the radial portion of the support structure.

9. An airfoil assembly for a gas turbine engine comprising:

an outer portion including an airfoil section extending in a radial direction from a first platform section, the airfoil section including an internal cavity, and the outer portion comprising a ceramic material;

a support structure having a radial portion extending in the radial direction from an axial portion, and the radial portion received in the internal cavity such that a gap is established between the outer portion and the axial portion of the support structure, and the gap extending from the internal cavity; and a flange extending in the radial direction from the first platform section of the outer portion such that the flange bounds the gap at a distance from the internal cavity;

wherein the flange includes a hook that curves outwardly from the first platform section and then wraps around the axial portion of the support structure such that a free end of the hook is axially aligned with, but radially offset from, the first platform section and such that the axial portion of the support structure is captured in a pocket of the hook.

10. The airfoil assembly as recited in claim 9, further comprising a seal positioned in the pocket of the hook, the seal spanning the gap between the axial portion of the support structure and the first platform section.

11. The airfoil assembly as recited in claim 9, wherein the support structure comprises a metallic material.

12. A turbine section for a gas turbine engine, comprising:

a plurality of turbine blades arranged circumferentially about an engine axis; and a plurality of vanes arranged circumferentially about the engine axis, each vane comprising:

an outer portion including an airfoil section extending in a radial direction from a first platform section, the airfoil section including an internal cavity, and the outer portion comprising a ceramic material;

a support structure having a radial portion extending in the radial direction from an axial portion, the radial portion received in the internal cavity such that a gap is established between the outer portion and the axial portion of the support structure, and the gap extending from the internal cavity; and at least one flange extending in the radial direction from the first platform section of the outer portion such that the at least one flange bounds the gap at a distance from the internal cavity;

wherein the gap includes an axial segment joined with a radial segment at a bend, the axial segment of the gap extends in an axial direction between the radial portion of the support structure and the first platform section, and the radial segment of the gap extends in the radial direction between the at least one flange and an edge face of the axial portion of the support structure.

13. The turbine section as recited in claim 12, wherein the support structure comprises a metallic material.

14. The turbine section as recited in claim 12, further comprising a seal positioned along the axial segment of the gap, wherein the seal spans between the axial portion of the support structure and the first platform section, and the at least one flange is positioned between the seal and the radial portion of the support structure.

15. A turbine section, for a gas turbine engine, comprising:

a plurality of turbine blades arranged circumferentially about an engine axis; and a plurality of vanes arranged circumferentially about the engine axis, each vane comprising:

an outer portion including an airfoil section extending in a radial direction from a first platform section, the airfoil section including an internal cavity, and the outer portion comprising a ceramic material;

a support structure having a radial portion extending in the radial direction from an axial portion, the radial portion received in the internal cavity such that a gap is established between the outer portion and the axial portion of the support structure, and the gap extending from the internal cavity; and at least one flange extending in the radial direction from the first platform section of the outer portion such that the at least one flange bounds the gap at a distance from the internal cavity;

wherein the gap includes an axial segment extending in an axial direction between the radial portion of the support structure and the first platform section, the at least one flange includes a raised protrusion extending outwardly from the first platform section at an intermediate position along the axial segment of the gap to establish a tortuous path, and the tortuous path has a lesser height along the raised protrusion than on either side of the raised protrusion.

16. The turbine section as recited in claim 15, wherein the at least one flange includes a hook that curves outwardly from the first platform section and then wraps around the axial portion of the support structure such that a free end of the hook is axially aligned with, but radially offset from, the first platform section and such that the axial portion of the support structure is situated in a pocket of the hook.

17. The turbine section as recited in claim 16, wherein the at least one flange includes a first flange and a second flange extending outwardly from opposite sides of the first platform section, and the hook of the first flange and the hook of the second flange cooperate to capture the axial portion of the support structure in the respective pockets.

18. The airfoil assembly as recited in claim 17, further comprising a plurality of seals positioned in the respective pockets of the first and second flanges, and wherein each of the seals spans the gap between the axial portion of the support structure and the first platform section.

19. The turbine section as recited in claim 15, wherein the support structure comprises a metallic material.

* * * * *